US009754523B2

(12) United States Patent
Lee et al.

(10) Patent No.: US 9,754,523 B2
(45) Date of Patent: Sep. 5, 2017

(54) POWER SUPPLY DEVICE AND DISPLAY DEVICE HAVING THE SAME

(71) Applicant: SAMSUNG DISPLAY CO., LTD., Yongin, Gyeonggi-Do (KR)

(72) Inventors: Yoon-Young Lee, Asan-si (KR); Kwang-Hun Kang, Cheonan-si (KR); Soon-Gi Kwon, Cheonan-si (KR); Sung-Chun Park, Suwon-si (KR); Jeong-Min Seo, Cheonan-si (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 203 days.

(21) Appl. No.: 14/698,119

(22) Filed: Apr. 28, 2015

(65) Prior Publication Data

US 2016/0133217 A1 May 12, 2016

(30) Foreign Application Priority Data

Nov. 12, 2014 (KR) ..... 10-2014-0156988

(51) Int. Cl.
*G09G 3/20* (2006.01)

(52) U.S. Cl.
CPC ..... *G09G 3/20* (2013.01); *G09G 2330/028* (2013.01)

(58) Field of Classification Search
CPC ..... G09G 3/3696; G09G 3/3648; G09G 2330/021; G09G 2300/0828
See application file for complete search history.

(56) References Cited

U.S. PATENT DOCUMENTS

| | | | | |
|---|---|---|---|---|
| 6,249,270 | B1 * | 6/2001 | Ito | G09G 3/3688 345/100 |
| 2006/0038479 | A1 * | 2/2006 | Fukuoka | H01J 29/04 313/493 |
| 2006/0214889 | A1 * | 9/2006 | Matsumoto | G09G 3/3233 345/76 |
| 2011/0050676 | A1 * | 3/2011 | Lee | G09G 3/3233 345/212 |
| 2011/0062925 | A1 * | 3/2011 | Han | G09G 3/3696 323/282 |
| 2016/0133217 | A1 * | 5/2016 | Lee | G09G 3/20 345/212 |

FOREIGN PATENT DOCUMENTS

| | | | |
|---|---|---|---|
| KR | 10-2008-0010789 | A | 1/2008 |
| KR | 10-2011-0032500 | A | 3/2011 |
| KR | 10-2011-0093151 | A | 8/2011 |
| KR | 10-2011-0097049 | A | 8/2011 |

* cited by examiner

*Primary Examiner* — Shaheda Abdin
(74) *Attorney, Agent, or Firm* — Lee & Morse, P.C.

(57) ABSTRACT

A power supply device includes a voltage range selector, a voltage level controller, and a power supply voltage generator. The voltage range selector generates a range selection signal to select a voltage control range. The voltage level controller generates a voltage level control signal based on a driving condition of a display panel. The power supply voltage generator generates a power supply voltage having a voltage level corresponding to the voltage level control signal within the voltage control range, and supplies the power supply voltage to the display panel.

17 Claims, 7 Drawing Sheets

POWER SUPPLY DEVICE AND DISPLAY DEVICE HAVING THE SAME

CROSS-REFERENCE TO RELATED APPLICATION

Korean Patent Application No. 10-2014-0156988, filed on Nov. 12, 2014, and entitled: "Power Supply Device and Display Device Having The Same," is incorporated by reference herein in its entirety.

BACKGROUND

1. Field

One or more embodiments described herein relate a power supply device and a display device having a power supply device.

2. Description of the Related Art

A display generates images based on data signals and a power supply voltage. The voltage levels of the data signals change according to grayscale levels or luminance levels, but the voltage level of the power supply voltage may not change based on grayscale or luminance levels. However, the voltage level of the power supply voltage may change based on other factors, such as the size of the display panel, environmental conditions, materials of the display panel, and power consumption, to name a few.

The power supply voltage for one device may be different for another device. For example, the power supply voltage of a smart phone may be different from the power supply voltage for a smart watch. Also, the voltage range of the power supply voltage may be limited, for example, by production costs, application requirements. etc.

SUMMARY

In accordance with one or more embodiments, a power supply device includes a voltage range selector to generate a range selection signal to select a voltage control range; a voltage level controller to generate a voltage level control signal based on a driving condition of a display panel; and a power supply voltage generator to generate a power supply voltage having a voltage level corresponding to the voltage level control signal within the voltage control range, and to supply the power supply voltage to the display panel.

The voltage range selector may generate the range selection signal based on a size of the display panel. The voltage range selector may generate the range selection signal based on an environmental condition of the display panel. The voltage range selector may generate the range selection signal based on temperature of the panel.

The voltage level controller may generate the voltage level control signal to reduce power consumption of the display panel. The voltage level controller may generate the voltage level control signal based on an amount of load of the display panel. The voltage level controller may generate the voltage level control signal based on a temperature of the display panel. The voltage level controller may generate the voltage level control signal to include at least one pulse.

The power supply voltage generator may include a pulse counter to count a number of pulses in the voltage level control signal and to output a pulse information signal having information indicative of the counted number of the pulses; a candidate power supply voltage generator to receive the pulse information signal from the pulse counter and to generate a plurality of candidate power supply voltages having different voltage levels based on the counted number of the pulses; and a multiplexer to select one of the candidate power supply voltages as the power supply voltage based on the range selection signal.

The candidate power supply voltage generator may include a plurality of tables to commonly receive the pulse information signal and to respectively output candidate voltage selection signals having different voltage levels based on the pulse information signal; and a digital-to-analog converter to generate the candidate power supply voltages based on the candidate voltage selection signals.

Each of the tables may include a voltage divider to generate a plurality of reference signals having different voltage levels by dividing a base voltage; and a candidate voltage selection signal selector to select one of the reference signals as one of the candidate voltage selection signals based on the pulse information signal.

The power supply voltage generator may include a pulse counter to count a number of pulses in the voltage level control signal and to output a pulse information signal having an information of the counted number of the pulses; a candidate reference voltage generator to receive the pulse information signal from the pulse counter and to generate a plurality of candidate reference voltages having different voltage levels based on the counted number of pulses; a multiplexer to select one of the candidate reference voltages as a reference voltage based on the range selection signal; and an amplifier to generate the power supply voltage based on the reference voltage.

The power supply voltage generator may include a pulse counter to count a number of pulses included in the voltage level control signal and to output a pulse information signal having an information of the counted number of the pulses; a power supply voltage selection signal supplier to select a reference table among a plurality of tables that respectively output power supply voltage selection signals having different voltage levels with respect to a same number of the pulses, and to supply one of the power supply voltage selection signals from the reference table based on the pulse information signal; and a digital-to-analog converter to generate the power supply voltage based on the one of the power supply voltage selection signals.

The power supply voltage selection signal supplier may include the tables; a table selector to select the reference table based on the range selection signal; and a power supply voltage selection signal generator to output the one of the power supply voltage selection signals from the reference table based on the pulse information signal.

The power supply voltage generator may include a pulse counter to count a number of pulses in the voltage level control signal and to output a pulse information signal having information indicative of the counted number of the pulses; a reference voltage selection signal supplier to select a reference table among a plurality of tables that respectively output reference voltage selection signals having different voltage levels with respect to a same number of the pulses, and to supply one of the reference voltage selection signals from the reference table based on the pulse information signal; a digital-to-analog converter to generate a reference voltage based on the one of the reference voltage selection signals; and an amplifier to generate the power supply voltage based on the reference voltage.

In accordance with one or more other embodiments, a display device includes a display panel including pixels; a display panel driver to drive the display panel; and a power supply device to supply power supply voltages to the display panel, wherein the power supply device includes: a voltage range selector to generate a range selection signal selecting a voltage control range; a voltage level controller to generate a voltage level control signal based on a driving condition of the display panel; and a power supply voltage generator to generate a power supply voltage having a voltage level corresponding to the voltage level control signal within the voltage control range and to supply the power supply voltage to the display panel.

The voltage range selector may generate the range selection signal based on a size of the display panel. The voltage level controller may generate the voltage level control signal to reduce power consumption of the display panel. The voltage level controller may generate the voltage level control signal based on an amount of load of the display panel. The voltage level controller may generate the voltage level control signal based on a temperature of the display panel.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
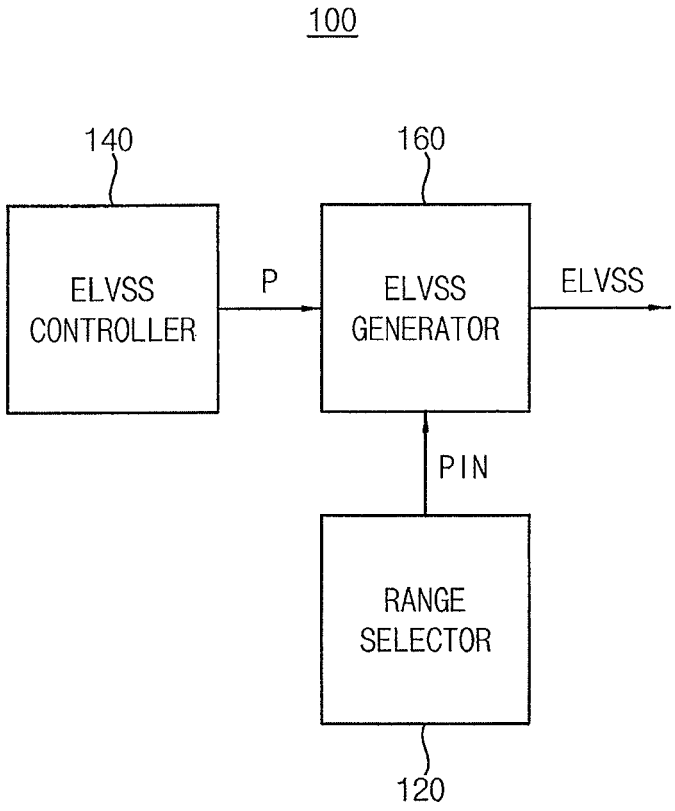
FIG. 1 illustrates an embodiment of a power supply device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout. Embodiments may be combined to form additional embodiments.

FIG. 1 illustrates an embodiment of a power supply device 100 which includes a voltage range selector 120, a voltage level controller 140, and a power supply voltage generator 160. The voltage range selector 120 may generate a range selection signal PIN selecting a voltage control range. The power supply voltage generator 160 may generate a power supply voltage ELVSS having a voltage level within the voltage control range, and may supply the power supply voltage ELVSS to the display panel. For example, the voltage control range may be a range within which the power supply voltage generator 160 controls the voltage level of the power supply voltage ELVSS, in response to a voltage level control signal P from the voltage level controller 140.

In one example embodiment, the voltage range selector 120 may generate the range selection signal PIN based on the size of a display panel. Voltage control ranges of the power supply voltage ELVSS may differ according to the size of the display panel. For example, the voltage control range of the power supply voltage ELVSS supplied to a display panel having a first size may be between −3V and −2V. On the other hand, the voltage control range of the power supply voltage ELVSS supplied to a display panel having a second size may be between −5V and −1V. In an example embodiment, the display panel may be included in a smart phone. In another example embodiment, the display panel may be in a monitor. In another example embodiment, the display panel may be in a smart watch.

In one example embodiment, the voltage range selector 120 may generate the range selection signal PIN based on environmental conditions of the display panel. An optimal voltage level of the power supply voltage ELVSS may change according to environmental conditions of the display panel.

In one example embodiment, the voltage range selector 120 may generate the range selection signal PIN based on a temperature at which the display panel is driven. For example, the voltage level of the power supply voltage ELVSS for driving the display panel in a high temperature environment (e.g., a power plant) may be higher than the voltage level of the power supply voltage ELVSS for driving the display panel in a low temperature environment (e.g., a spacecraft). Therefore, the power supply voltage generator 160 may generate the power supply voltage ELVSS having a higher voltage level based on the range selection signal PIN. Thus, the power supply voltage generator 160 may generate the power supply voltage ELVSS of the higher voltage level within the voltage control range and may supply the power supply voltage ELVSS to the display panel.

The voltage level controller 140 may generate the voltage level control signal P based on the driving condition of the display panel. Accordingly, the power supply voltage generator 160 may generate the power supply voltage ELVSS having a voltage level corresponding to the voltage level control signal P. However, the range of the voltage level of the power supply voltage ELVSS controlled by the voltage level control signal P may be limited within the voltage control range.

In one example embodiment, the voltage level controller 140 may generate the voltage level control signal P to reduce power consumption of the display panel. Power consumption of the display panel may differ according to the voltage level of the power supply voltage ELVSS. For example, a display panel which includes an organic light emitting diode may receive another power supply voltage, in addition to power supply voltage ELVSS. Power consumption of the display panel may be proportional to the voltage difference between the power supply voltage ELVSS and the other power supply voltage. Therefore, the voltage level of the power supply voltage ELVSS or the other power supply voltage may be changed to reduce the voltage difference.

In one example embodiment, the display panel may include a driving transistor to generate a driving current applied to the organic light emitting diode, and the other power supply voltage may be supplied to a source terminal of the driving transistor. Therefore, the voltage difference between a gate terminal and the source terminal of the driving transistor may change when the voltage level of the other power supply voltage changes. As a result, the driving current may change. Therefore, the voltage level of the power supply voltage ELVSS may be controlled to reduce the power consumption of the display panel.

In one example embodiment, the voltage level controller 140 may generate the voltage level control signal P based on an amount of load of the display panel. The amount of load of the display panel may be proportional to, for example, the sum of driving currents of the display panel. Since the power consumption increases as the amount of load of the display panel increases, the voltage level controller 140 may reduce the voltage level of the power supply voltage ELVSS.

In one example embodiment, the voltage level controller 140 may generate the voltage level control signal P based on a temperature at which the display panel is driven. The temperature of the display panel may increase or decrease according to a driving of the display panel. The voltage level controller 140 may control the voltage level of the power supply voltage ELVSS based on the voltage level control signal P, to supply the power supply voltage ELVSS having an optimal voltage level according to change of the temperature of the display panel.

In one example embodiment, the voltage level controller 140 may generate the voltage level control signal P to include at least one pulse. The voltage level controller 140 may supply the at least one pulse to the power supply voltage generator 160 through a single wire. The power supply voltage generator 160 may generate the power supply voltage ELVSS to have the voltage level that corresponds to the voltage level control signal P within the voltage control range, and may supply the power supply voltage ELVSS to the display panel.

In one example embodiment, the power supply voltage generator 160 may include a pulse counter, a candidate power supply voltage generator, and a multiplexer. The pulse counter may count the number of pulses in the voltage level control signal P and may output a pulse information signal PN having information of the counted number of pulses. The candidate power supply voltage generator may receive the signal from the pulse counter and generate a plurality of candidate power supply voltages having different voltage levels based on the counted number of the pulses.

The multiplexer may select one of the candidate power supply voltages as the power supply voltage ELVSS based on the range selection signal PIN. In one example embodiment, the candidate power supply voltage generator may include a plurality of tables and a digital-to-analog converter. The tables may commonly receive the pulse information signal PN and respectively output candidate voltage selection signals having different voltage levels based on the pulse information signal PN.

The digital-to-analog converter may generate the candidate power supply voltages based on the candidate voltage selection signals. In one example embodiment, each of the tables may include a voltage divider, and a candidate voltage selection signal selector. The voltage divider may generate a plurality of reference signals having different voltage levels by dividing a base voltage. The candidate voltage selection signal selector may select one of the reference signals as one of the candidate voltage selection signals in response to the pulse information signal PN.

In one example embodiment, the power supply voltage generator 160 may include a pulse counter, a candidate reference voltage generator, a multiplexer, and an amplifier. The pulse counter may count the number of pulses in the voltage level control signal P and output the pulse information signal PN having information indicative of the counted number of pulses. The candidate reference voltage generator may receive the signal from the pulse counter and generate a plurality of candidate reference voltages having different voltage levels based on the counted number of pulses. The multiplexer may select one of the candidate reference voltages as a reference voltage based on the range selection signal PIN. The amplifier may generate the power supply voltage ELVSS based on the reference voltage.

In one example embodiment, the power supply voltage generator 160 may include a pulse counter, a power supply voltage selection signal supplier, and a digital-to-analog converter. The pulse counter may count the number of pulses in the voltage level control signal P and output a pulse information signal PN having information indicative of the counted number of pulses. The power supply voltage selection signal supplier may select a reference table, from among a plurality of tables, that respectively output power supply voltage selection signals having different voltage levels with respect to the same number of the pulses. The power supply voltage selection signal supplier may supply one of the power supply voltage selection signals from the reference table based on the pulse information signal PN. The digital-to-analog converter generates the power supply voltage ELVSS based on the power supply voltage selection signal.

In one example embodiment, the power supply voltage selection signal supplier may include the plurality of tables, a table selector, and a power supply voltage selection signal generator. The table selector may select the reference table based on the range selection signal PIN. The power supply voltage selection signal generator may output the one of the power supply voltage selection signals from the reference table based on the pulse information signal PN.

In one example embodiment, the power supply voltage generator 160 may include a pulse counter, a reference voltage selection signal supplier, a digital-to-analog converter, and an amplifier. The pulse counter may count a number of pulses in the voltage level control signal P and may output the pulse information signal PN having information of the counted number of pulses. The reference voltage selection signal supplier may select a reference table, among a plurality of tables, that respectively output reference voltage selection signals having different voltage levels with respect to the same number of the pulses. The reference voltage selection signal supplier may supply one of the reference voltage selection signals from the reference table based on the pulse information signal PN. The digital-to-analog converter may generate the reference voltage based on the one of the reference voltage selection signals. The amplifier may generate the power supply voltage ELVSS based on the reference voltage.

In accordance with one or more embodiments, the range of the voltage level of the power supply voltage ELVSS controlled by the voltage level controller 140 may be changed according to the range selection signal PIN. As a result, the supply range of the power supply voltage ELVSS may be expanded. The power supply device 100 may therefore be applied to various electronic products that include or are coupled to a display device. Examples include a smart phone, a wearable device, or another type of electronic device.

Figure 2:
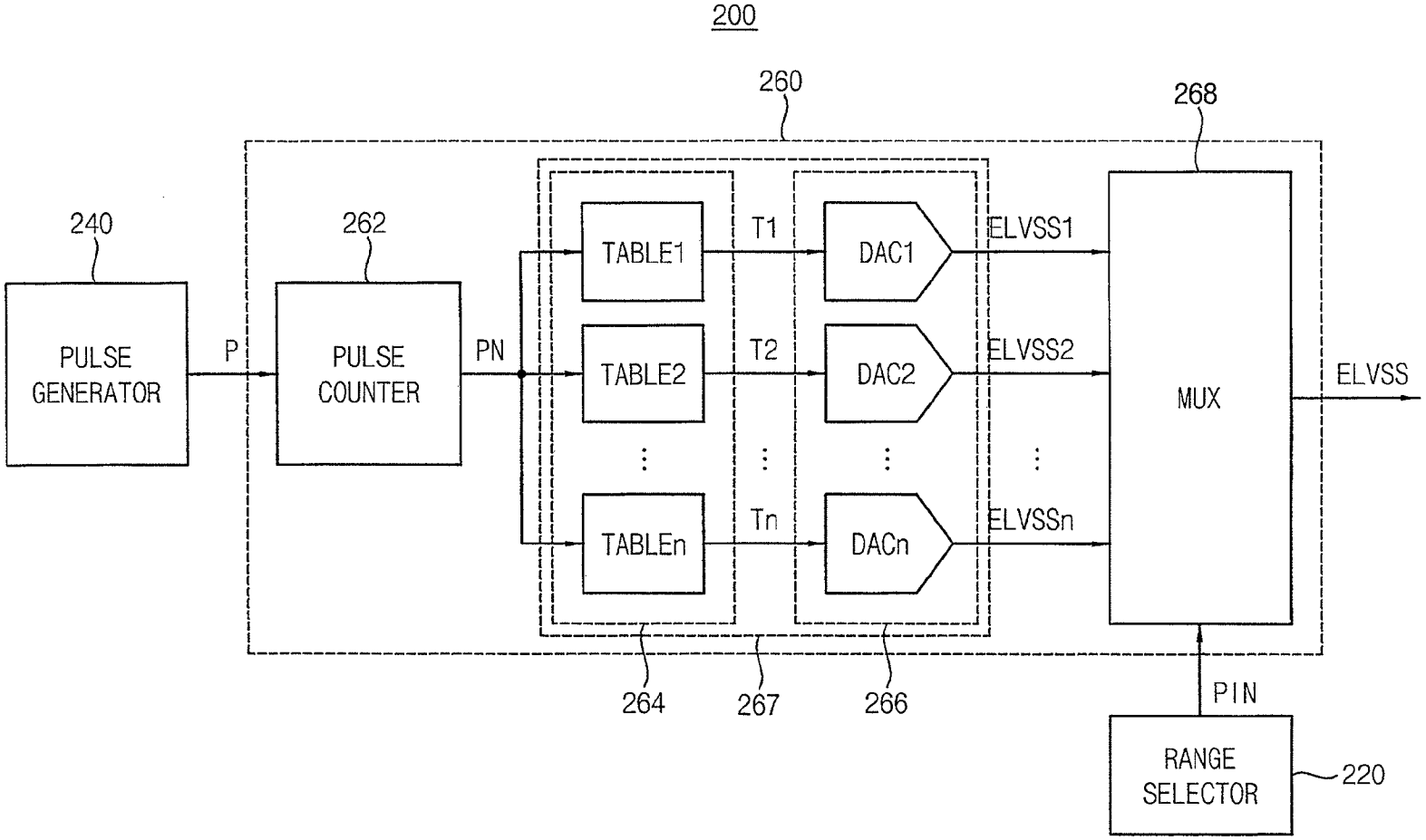
FIG. 2 illustrates another embodiment of a power supply device.

FIG. 2 illustrates an embodiment of a power supply device 200, which, for example, may correspond to the power supply device 100 in FIG. 1. Referring to FIG. 2, the power supply device 200 includes a voltage range selector 220, a voltage level controller 240, and a power supply voltage generator 260.

The voltage range selector 220 generates a range selection signal PIN selecting a voltage control range. The voltage level controller 240 may generate the voltage level control signal P based on a driving condition of the display panel. The voltage level control signal P may include at least one pulse.

The power supply voltage generator 260 generates a power supply voltage ELVSS having a voltage level corresponding to the voltage level control signal P within the voltage control range, and may supply the power supply voltage ELVSS to the display panel. The power supply voltage generator 260 may include a pulse counter 262, a candidate power supply voltage generator 267, and a multiplexer 268.

The pulse counter 262 may count the number of pulses in the voltage level control signal P, and may output a pulse information signal PN having information of the counted number of pulses. The candidate power supply voltage generator 267 may generate a plurality of the candidate power supply voltages ELVSS1 through ELVSSn having different voltage levels based on the counted number of the pulses.

The candidate power supply voltage generator 267 may include a plurality of tables 264, and a digital-to-analog converter 266. The tables 264 may commonly receive pulse information signal PN and respectively output candidate voltage selection signals T1 through Tn having different voltage levels based on the pulse information signal PN.

Each of the tables 264 may include a voltage divider and a candidate voltage selection signal selector. The voltage divider may generate a plurality of reference signals having different voltage levels by dividing a base voltage. The candidate voltage selection signal selector may select one of the reference signals as one of the candidate voltage selection signals T1 through Tn based on the pulse information signal PN.

The digital-to-analog converter 266 may generate the candidate power supply voltages ELVSS1 through ELVSSn based on the candidate voltage selection signals T1 through Tn. The multiplexer 268 may select one of the candidate power supply voltages ELVSS1 through ELVSSn as the power supply voltage ELVSS based on the range selection signal PIN.

Figure 3:
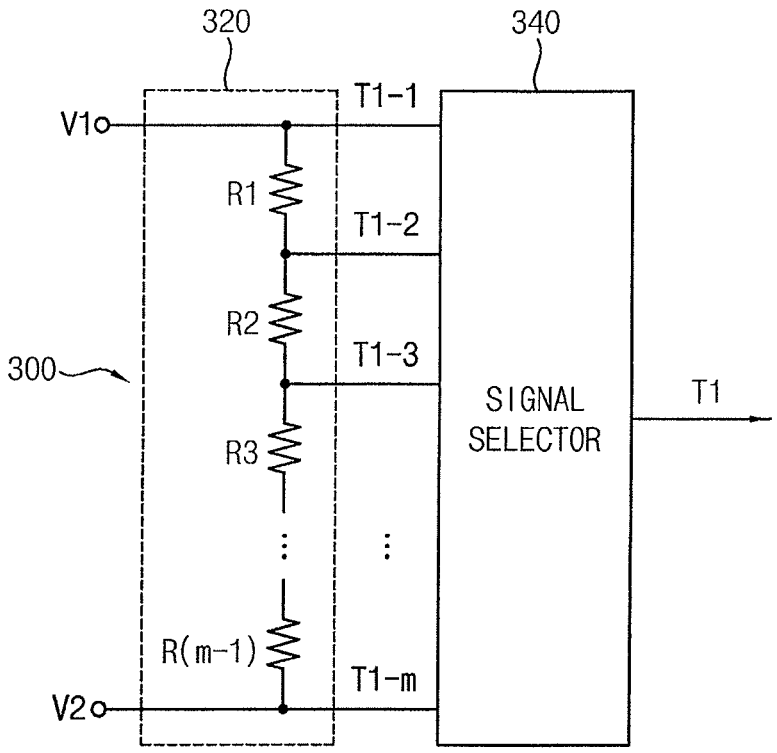
FIG. 3 illustrates an embodiment of a table in the power supply device.

FIG. 3 illustrates an embodiment of a table 300 in the power supply device of FIG. 2. Referring to FIG. 3, the table 300 includes a voltage divider 320 and a candidate voltage selection signal selector 340.

The voltage divider 320 generates a plurality of reference signals T1-1 through T1-*m* having different voltage levels by dividing a base voltage V1-V2. The voltage divider 320 may include, for example, resistors, e.g., a plurality of the resistors R1 through R(m−1). The voltage divider 320 divides the base voltage V1-V2 based on the voltage division rule. As a result, a plurality of reference signals T1-1 through T1-*m* having the different voltage levels are generated. The candidate voltage selection signal selector 340 selects one of the reference signals T1-1 through T1-*m* as one T1 of candidate voltage selection signals T1 through Tn of FIG. 2.

Figure 4:
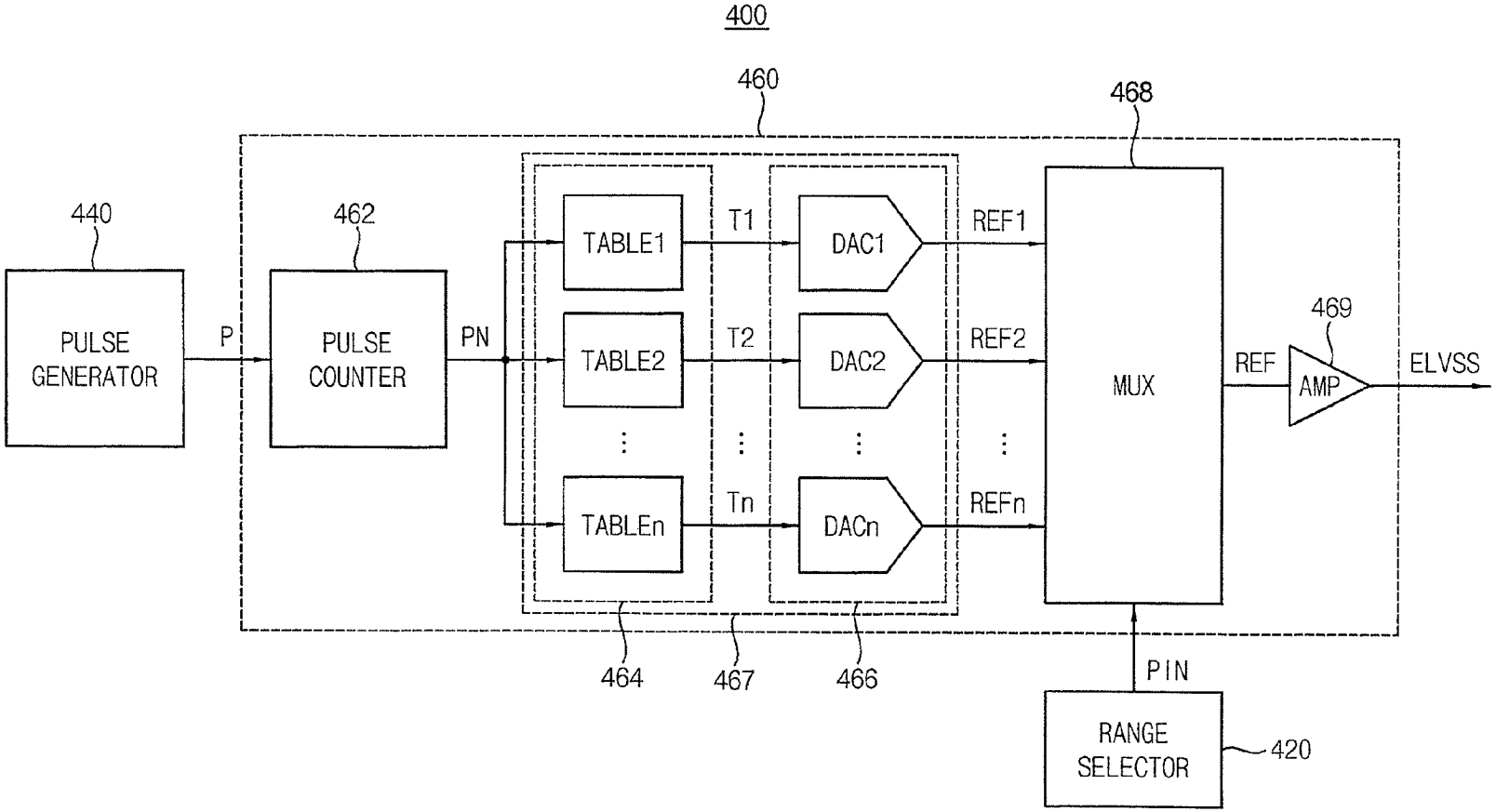
FIG. 4 illustrates another embodiment of a power supply device.

FIG. 4 illustrates another embodiment of a power supply device 400, which, for example, may correspond to FIG. 1. Referring to FIG. 4, the power supply device 400 includes a voltage range selector 420, a voltage level controller 440, and a power supply voltage generator 460.

The voltage range selector 420 generates a range selection signal PIN selecting a voltage control range. The voltage level controller 440 may generate a voltage level control signal P based on a driving condition of a display panel. The voltage level control signal P may include at least one pulse.

The power supply voltage generator 460 generates a power supply voltage ELVSS having a voltage level corresponding to the voltage level control signal P within the voltage control range, and may supply the power supply voltage ELVSS to the display panel. The power supply voltage generator 460 includes a pulse counter 462, a candidate reference voltage generator 467, a multiplexer 468, and an amplifier 469.

The pulse counter 462 may count a number of pulses in the voltage level control signal P, and may output a pulse information signal PN having information of the counted number of pulses. The candidate reference voltage generator 467 may generate a plurality of candidate reference voltages REF1 through REFn having different voltage levels based on the counted number of pulses.

The candidate reference voltage generator 467 may include a plurality of tables 464 and a digital-to-analog converter 466. The plurality of tables 464 may commonly receive the pulse information signal PN and respectively output candidate voltage selection signals T1 through Tn having different voltage levels based on the pulse information signal PN.

Each of the tables 464 may include a voltage divider and a candidate voltage selection signal selector. The voltage divider generates a plurality of reference signals having different voltage levels by dividing a base voltage. The candidate voltage selection signal selector selects one of the reference signals as one of the candidate voltage selection signals T1 through Tn based on the pulse information signal PN.

The digital-to-analog converter 466 generates the candidate reference voltages REF1 through REFn based on the candidate voltage selection signals T1 through Tn. The multiplexer 468 selects one of the candidate reference voltages REF1 through REFn as a reference voltage REF based on the range selection signal PIN. The amplifier 469 generates the power supply voltage ELVSS based on the reference voltage REF.

Figure 5:
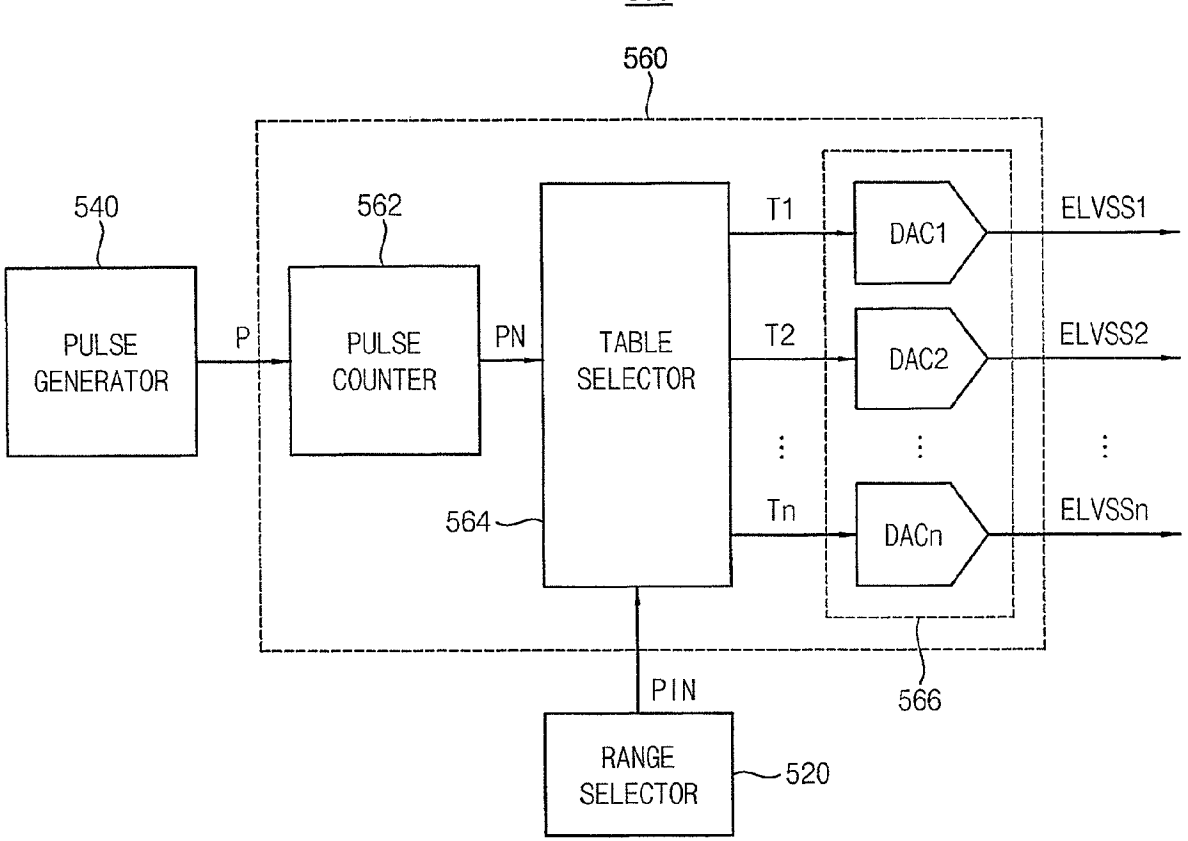
FIG. 5 illustrates another embodiment of a power supply device.
Figure 6:
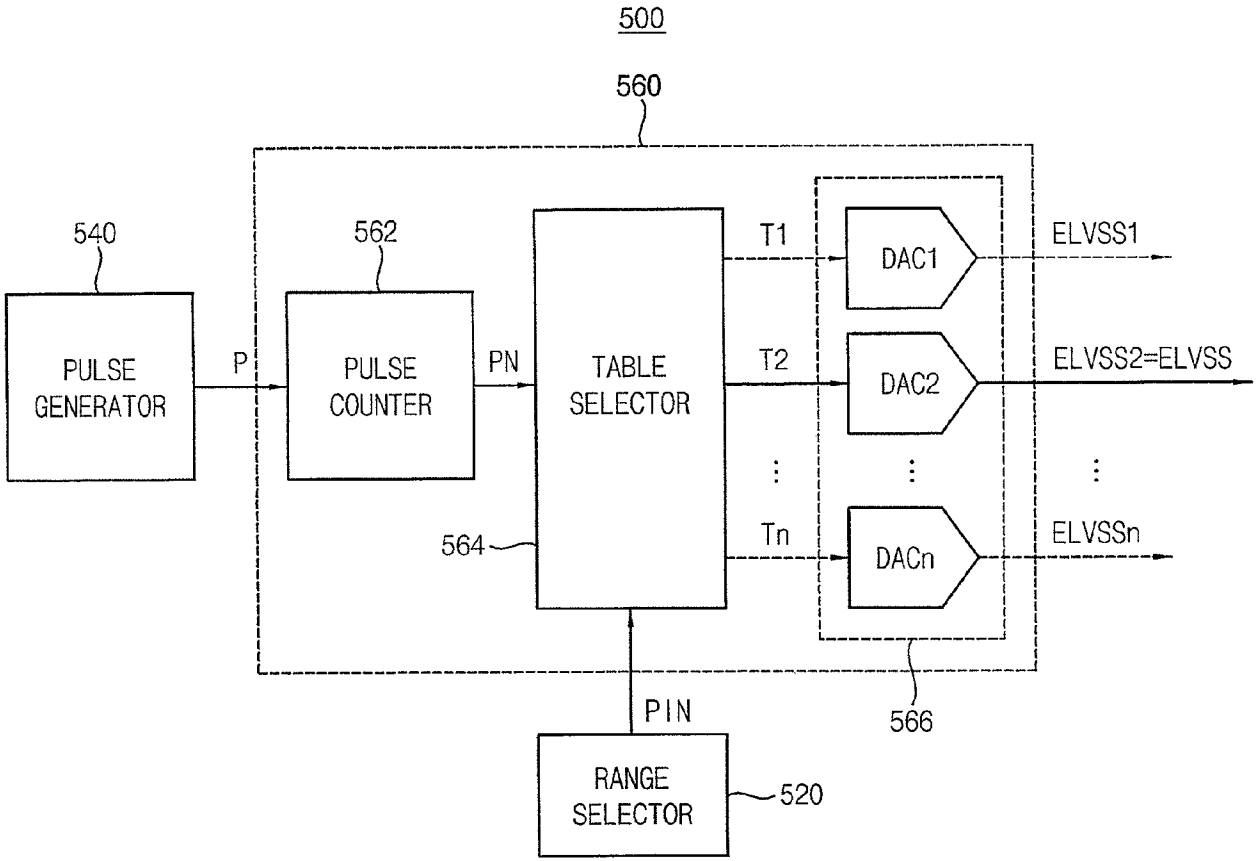
FIG. 6 illustrates an example application of the power supply device.

FIG. 5 illustrates another embodiment of a power supply device 500, which, for example, may correspond to of FIG. 1. FIG. 6 illustrates an example of the operation of the power supply device in FIG. 5.

Referring to FIGS. 5 and 6, the power supply device 500 includes a range selector 520, a voltage level controller 540, and a power supply voltage generator 560. The voltage range selector 520 generates a range selection signal PIN selecting a voltage control range. The voltage level controller 540 may generate a voltage level control signal P based on a driving condition of a display panel. The voltage level control signal P may include at least one pulse.

The power supply voltage generator 560 generates a power supply voltage ELVSS having a voltage level corresponding to the voltage level control signal P within the voltage control range, and supplies the power supply voltage ELVSS to the display panel. The power supply voltage generator 560 includes a pulse counter 562, a power supply voltage selection signal supplier 564, and a digital-to-analog converter 566.

The pulse counter 562 counts a number of pulses in the voltage level control signal P and outputs a pulse information signal PN having information of the counted number of pulses.

The power supply voltage selection signal supplier 564 selects a reference table T2 among a plurality of tables T1 through Tn. The tables respectively include power supply voltage selection signals having different voltage levels with respect to the same number of the pulses. The power supply voltage selection signal supplier 564 may supply one of the power supply voltage selection signals having a certain voltage level from the reference table T2 based on the pulse information signal PN.

The power supply voltage selection signal supplier 564 may include the plurality of the tables T1 through Tn, a table selector, and a power supply voltage selection signal generator. The table selector may select the reference table T2 based on the range selection signal PIN. The power supply voltage selection signal generator may output the one of the power supply voltage selection signals from the reference table based on the pulse information signal PN.

The digital-to-analog converter 566 may generate the power supply voltage ELVSS based on the one of the power supply voltage selection signals. The power supply voltage ELVSS2 generated by the digital-to-analog converter 566 based on the power supply voltage selection signal supplied by the reference table T2 may be supplied to the display panel.

Figure 7:
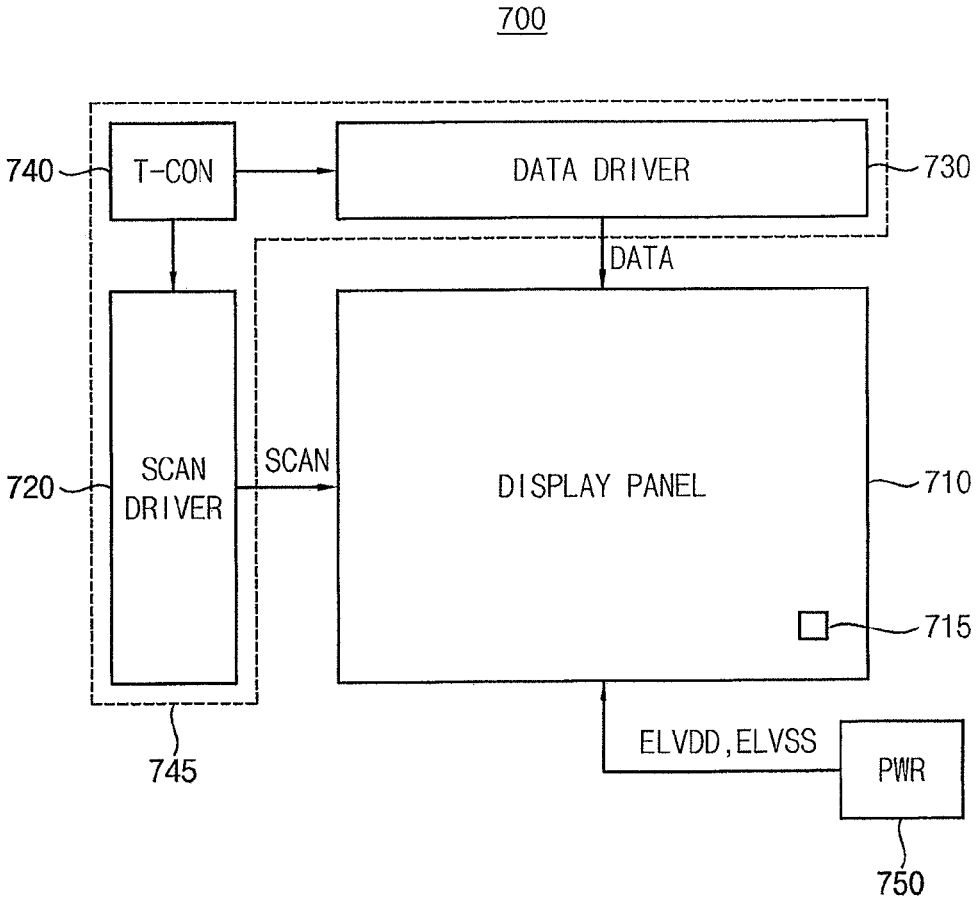
FIG. 7 illustrates an embodiment of a display device.

FIG. 7 illustrates another embodiment of a display device 700 which includes a display panel 710, a display panel driver 745, and a power supply device 750. The display panel 710 includes a plurality of pixels which are driven by the display panel driver 745. The display panel driver 745 may include a scan driver 720, a data driver 730, and a timing controller 740. The scan driver 720 may supply scan signals SCAN to the display panel 710. The data driver 730 may supply data signals DATA to the display panel 710 during activation period of the scan signals SCAN. The timing controller 740 may control the scan driver 720 and the data driver 730.

The power supply device 750 may supply power supply voltages ELVDD and ELVSS to the display panel 710. The power supply device 750 may include a voltage range selector, a voltage level controller, and a power supply voltage generator.

The voltage range selector may generate a range selection signal selecting a voltage control range. Accordingly, the power supply voltage generator may generate the power supply voltage ELVSS having a voltage level within the voltage control range and may supply the power supply voltage ELVSS to the display panel. For example, the voltage control range may be a range within which the power supply voltage generator may control the voltage level of the power supply voltage ELVSS based on a voltage level control signal from the voltage level controller.

In one example embodiment, the voltage range selector may generate the range selection signal based on a size of a display panel 710. Voltage control ranges of the power supply voltage ELVSS may differ according to the size of the display panel 710. In one example embodiment, display panel 710 may be in a smart phone. In another example embodiment, display panel 710 may be in a monitor. In another example embodiment, display panel 710 may be in a smart watch.

The voltage range selector may generate the range selection signal PIN based on an environmental condition of the display panel 710. An optimal voltage level of the power supply voltage ELVSS may change according to the environment condition.

In one example embodiment, the voltage range selector may generate the range selection signal PIN based on a temperature at which the display panel 710 is driven.

The voltage level controller may generate the voltage level control signal based on the driving condition of the display panel 710. Accordingly, the power supply voltage generator may generate the power supply voltage ELVSS having a voltage level corresponding to the voltage level control signal. However, the range of the voltage level of the power supply voltage ELVSS controlled by the voltage level control signal may be limited within the voltage control range.

In one example embodiment, the voltage level controller generates the voltage level control signal to reduce power consumption of the display panel 710. Power consumption of the display panel 710 may differ according to the voltage level of the power supply voltage ELVSS.

In one example embodiment, the voltage level controller generates the voltage level control signal based on an amount of load of the display panel 710. The amount of load of the display panel 710 may be proportional to a sum of driving currents of the display panel 710. Since the power consumption increases as the amount of load of the display panel 710 increases, the voltage level controller may reduce the voltage level of the power supply voltage ELVSS.

In one example embodiment, the voltage level controller may generate the voltage level control signal based on a temperature of the display panel 710. The temperature of the display panel 710 may increase or decrease according to driving of the display panel 710. The voltage level controller may control the voltage level of the power supply voltage ELVSS based on the voltage level control signal, to supply the power supply voltage ELVSS having an optimal or other predetermined voltage level according to change of the temperature of the display panel 710.

In one example embodiment, the voltage level controller generates the voltage level control signal including at least one pulse. The voltage level controller may supply the voltage level control signal, including at least one pulse, to the power supply voltage generator through a single wire. The power supply voltage generator may generate the power supply voltage ELVSS having the voltage level corresponding to the voltage level control signal within the voltage control range, and may supply the power supply voltage ELVSS to the display panel 710.

In one example embodiment, the power supply voltage generator may include a pulse counter, a candidate power supply voltage generator, and a multiplexer. The pulse counter may count the number of pulses in the voltage level control signal, and may output a pulse information signal having information of the counted number of pulses. The candidate power supply voltage generator may receive the signal from the pulse counter, and may generate a plurality of candidate power supply voltages having different voltage levels based on the counted number of pulses. The multiplexer may select one of the candidate power supply voltages as the power supply voltage ELVSS based on the range selection signal.

In one example embodiment, the candidate power supply voltage generator includes a plurality of tables and a digital-to-analog converter. The tables may commonly receive the pulse information signal and respectively output candidate voltage selection signals having different voltage levels in response to the pulse information signal. The digital-to-analog converter generates the candidate power supply voltages based on the candidate voltage selection signals.

In one example embodiment, each of the tables includes a voltage divider and a candidate voltage selection signal selector. The voltage divider generates a plurality of reference signals having different voltage levels by dividing a base voltage. The candidate voltage selection signal selector selects one of the reference signals as one of the candidate voltage selection signals based on the pulse information signal.

In one example embodiment, the power supply voltage generator includes a pulse counter, a candidate reference voltage generator, a multiplexer, and an amplifier. The pulse counter counts the number of pulses included in the voltage level control signal, and outputs the pulse information signal having the information of the counted number of pulses. The candidate reference voltage generator receives the signal from the pulse counter, and generates a plurality of candidate reference voltages having different voltage levels based on the counted number of pulses. The multiplexer selects one of the candidate reference voltages as a reference voltage based on the range selection signal. The amplifier generates power supply voltage ELVSS based on the reference voltage.

In one example embodiment, the power supply voltage generator includes a pulse counter, a power supply voltage selection signal supplier, and a digital-to-analog converter. The pulse counter counts the number of pulses in the voltage level control signal and output a pulse information signal having information of the counted number of pulses. The power supply voltage selection signal supplier selects a reference table among a plurality of tables that respectively output power supply voltage selection signals having different voltage levels with respect to the same number of the pulses. The power supply voltage selection signal supplier supplies one of the power supply voltage selection signals from the reference table based on the pulse information signal. The digital-to-analog converter generates the power supply voltage ELVSS based on the supplied power supply voltage selection signal.

In one example embodiment, the power supply voltage selection signal supplier includes the plurality of the tables, a table selector, and a power supply voltage selection signal generator. The table selector selects the reference table based on the range selection signal. The power supply voltage selection signal generator outputs one of the power supply voltage selection signals from the reference table based on the pulse information signal.

In one example embodiment, the power supply voltage generator includes a pulse counter, a reference voltage selection signal supplier, a digital-to-analog converter, and an amplifier. The pulse counter may count a number of pulses in the voltage level control signal and output the pulse information signal having information of the counted number of pulses. The reference voltage selection signal supplier selects a reference table among a plurality of tables that respectively output reference voltage selection signals having different voltage levels with respect to the same number of the pulses. The reference voltage selection signal supplier supplies one of the reference voltage selection signals from the reference table based on the pulse information signal. The digital-to-analog converter generates the reference voltage based on the supplied reference voltage selection signal. The amplifier generates the power supply voltage ELVSS based on the reference voltage.

As described above, the range of the voltage level of the power supply voltage ELVSS controlled by the voltage level controller may be changed according to the range selection signal. As a result, the power supply device 750 may expand the supply range of the power supply voltage ELVSS effectively. Therefore, the power supply device 750 may be applied to various display devices (e.g., a smart phone, a wearable device, etc).

The aforementioned embodiments may be applied to a variety of electronic devices that includes or is coupled to a display device. Examples include a computer, a laptop, a digital camera, a digital camcorder, a cellular phone, a smart phone, a smart pad, a PMP, a PDA, an MP3 player, a navigation system, a video phone, a monitoring system, a tracking system, a motion detecting system, and an image stabilization system.

By way of summation and review, the voltage level of a power supply voltage may change based on a variety of parameters, not the least of which includes the size of a display panel, environmental conditions, materials used to fabricate the display panel, and degree of power consumption. For example, the power supply voltage for a smart phone may be different from the power supply voltage for a smart watch.

In accordance with one or more of the aforementioned embodiments, a power supply device selects a voltage control range and controls the voltage level based on one or more driving conditions of the display panel. The power supply device may supply the power supply voltage within one of a plurality of voltage ranges. Therefore, a supply range of the power supply voltage may be effectively expanded or specifically tailored to a desired application, which allows the power supply device to be applied to various display devices including but not limited to smart phones, wearable electronic devices, tablets, computers, media players, and other devices.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. A power supply device, comprising:

a voltage range selector to generate a range selection signal to select a voltage control range;

a voltage level controller to generate a voltage level control signal based on a driving condition of a display panel; and a power supply voltage generator to generate a power supply voltage having a voltage level corresponding to the voltage level control signal within the voltage control range, and to supply the power supply voltage to the display panel, wherein the power supply voltage generator includes:

a pulse counter to count a number of pulses in the voltage level control signal and to output a pulse information signal having information indicative of the counted number of the pulses;

a candidate power supply voltage generator to receive the pulse information signal from the pulse counter and to generate a plurality of candidate power supply voltages having different voltage levels based on the counted number of the pulses; and a selector to select one of the candidate power supply voltages as the power supply voltage based on the range selection signal.

2. The device as claimed in claim 1, wherein the voltage range selector is to generate the range selection signal based on a size of the display panel.

3. The device as claimed in claim 1, wherein the voltage range selector is to generate the range selection signal based on an environmental condition of the display panel.

4. The device as claimed in claim 3, wherein the voltage range selector is to generate the range selection signal based on a temperature of the display panel.

5. The device as claimed in claim 1, wherein the voltage level controller is to generate the voltage level control signal to reduce power consumption of the display panel.

6. The device as claimed in claim 1, wherein the voltage level controller is to generate the voltage level control signal based on an amount of load of the display panel.

7. The device as claimed in claim 1, wherein the voltage level controller is to generate the voltage level control signal based on a temperature of the display panel.

8. The device as claimed in claim 1, wherein:

the number of pulses includes at least one pulse, and the selector includes a multiplexer.

9. The device as claimed in claim 1, wherein the candidate power supply voltage generator includes:

a plurality of tables to commonly receive the pulse information signal and to respectively output candidate voltage selection signals having different voltage levels based on the pulse information signal; and a digital-to-analog converter to generate the candidate power supply voltages based on the candidate voltage selection signals.

10. The power supply device as claimed in claim 9, wherein each of the tables includes:

a voltage divider to generate a plurality of reference signals having different voltage levels by dividing a base voltage; and a candidate voltage selection signal selector to select one of the reference signals as one of the candidate voltage selection signals based on the pulse information signal.

11. A power supply device, comprising:

a voltage range selector to generate a range selection signal to select a voltage control range;

a voltage level controller to generate a voltage level control signal based on a driving condition of a display panel; and a power supply voltage generator to generate a power supply voltage having a voltage level corresponding to the voltage level control signal within the voltage control range, and to supply the power supply voltage to the display panel, wherein the power supply voltage generator includes:

a pulse counter to count a number of pulses included in the voltage level control signal and to output a pulse information signal having an information of the counted number of the pulses;

a power supply voltage selection signal supplier to select a reference table among a plurality of tables that respectively output power supply voltage selection signals having different voltage levels with respect to a same number of the pulses, and to supply one of the power supply voltage selection signals from the reference table based on the pulse information signal; and a digital-to-analog converter to generate the power supply voltage based on the one of the power supply voltage selection signals.

12. The device as claimed in claim 11, wherein the power supply voltage selection signal supplier includes:

the plurality of tables;

a table selector to select the reference table based on the range selection signal; and a power supply voltage selection signal generator to output the one of the power supply voltage selection signals from the reference table based on the pulse information signal.

13. A display device, comprising:

a display panel including pixels;

a display panel driver to drive the display panel; and a power supply device to supply power supply voltages to the display panel, wherein the power supply device includes:

a voltage range selector to generate a range selection signal selecting a voltage control range;

a voltage level controller to generate a voltage level control signal based on a driving condition of the display panel; and a power supply voltage generator to generate a power supply voltage having a voltage level corresponding to the voltage level control signal within the voltage control range and to supply the power supply voltage to the display panel, wherein the power supply voltage generator includes:

a pulse counter to count a number of pulses in the voltage level control signal and to output a pulse information signal having information indicative of the counted number of the pulses;

a candidate power supply voltage generator to receive the pulse information signal from the pulse counter and to generate a plurality of candidate power supply voltages having different voltage levels based on the counted number of the pulses; and a selector to select one of the candidate power supply voltages as the power supply voltage based on the range selection signal.

14. The device as claimed in claim 13, wherein the voltage range selector is to generate the range selection signal based on a size of the display panel.

15. The device as claimed in claim 13, wherein the voltage level controller is to generate the voltage level control signal to reduce power consumption of the display panel.

16. The device as claimed in claim 13, wherein the voltage level controller is to generate the voltage level control signal based on an amount of load of the display panel.

17. The device as claimed in claim 13, wherein the voltage level controller is to generate the voltage level control signal based on a temperature of the display panel.

* * * * *